US005964639A

United States Patent [19]

Maxim

[11] Patent Number: 5,964,639

[45] Date of Patent: Oct. 12, 1999

[54] TOY WITH DIRECTIONALLY SELECTABLE SPRING-LOADED PROPULSION MECHANISMS

[76] Inventor: John G. Maxim, 863 Coventry St., Boca Raton, Fla. 33487-3106

[21] Appl. No.: 08/928,108

[22] Filed: Sep. 12, 1997

[51] Int. Cl.[6] ..... A63H 17/00; A63H 33/00; G09B 23/08

[52] U.S. Cl. ..... 446/437; 446/4; 446/486; 434/302

[58] Field of Search ..... 446/4, 6, 310, 446/312, 409, 429, 430, 431, 437, 458, 459, 462, 486; 473/571, 595; 434/300, 302

[56] References Cited

U.S. PATENT DOCUMENTS

| | | | |
|---|---|---|---|
| 1,277,702 | 9/1918 | Des Combes | 446/4 X |
| 2,078,382 | 4/1937 | Hanshaw . | |
| 2,627,700 | 2/1953 | Weiss . | |
| 3,106,397 | 10/1963 | Lacey . | |
| 3,564,756 | 2/1971 | Yokoi | 446/4 |
| 3,774,586 | 11/1973 | Saito | 446/435 X |
| 4,466,214 | 8/1984 | Kulesza et al. . | |
| 4,884,989 | 12/1989 | Wong | 446/431 X |
| 4,925,428 | 5/1990 | Sonesson . | |
| 5,297,981 | 3/1994 | Maxim et al. . | |
| 5,380,231 | 1/1995 | Brovelli | 446/6 |
| 5,618,219 | 4/1997 | Simone et al. . | |
| 5,683,285 | 11/1997 | Wong | 446/437 X |

*Primary Examiner*—D Neal Muir
*Attorney, Agent, or Firm*—Oltman,Flynn & Kubler

[57] ABSTRACT

A toy is for entertaining a user includes a shell portion configured to execute a play function, and at least one propulsion mechanism including a spring-loaded, directionally selectable propulsion member connected to the shell portion. The triggering object is optionally a play surface and the shell portion optionally includes a play ball having several of the propulsion mechanisms distributed over its surface for depressing and tilting by the user in individually selected directions into engagement with the shoulder engaging structure, so that projecting the ball against the play surface causes at least one of the projection members to contact the play surface and release the at least one projection member from engagement with its shoulder engaging structure, and so that the at least one projection member springs outwardly and delivers a propulsion member force against the play surface in a direction corresponding to the direction in which the projection member was tilted and the force combines with and alters the existing directional momentum of the play ball.

8 Claims, 4 Drawing Sheets

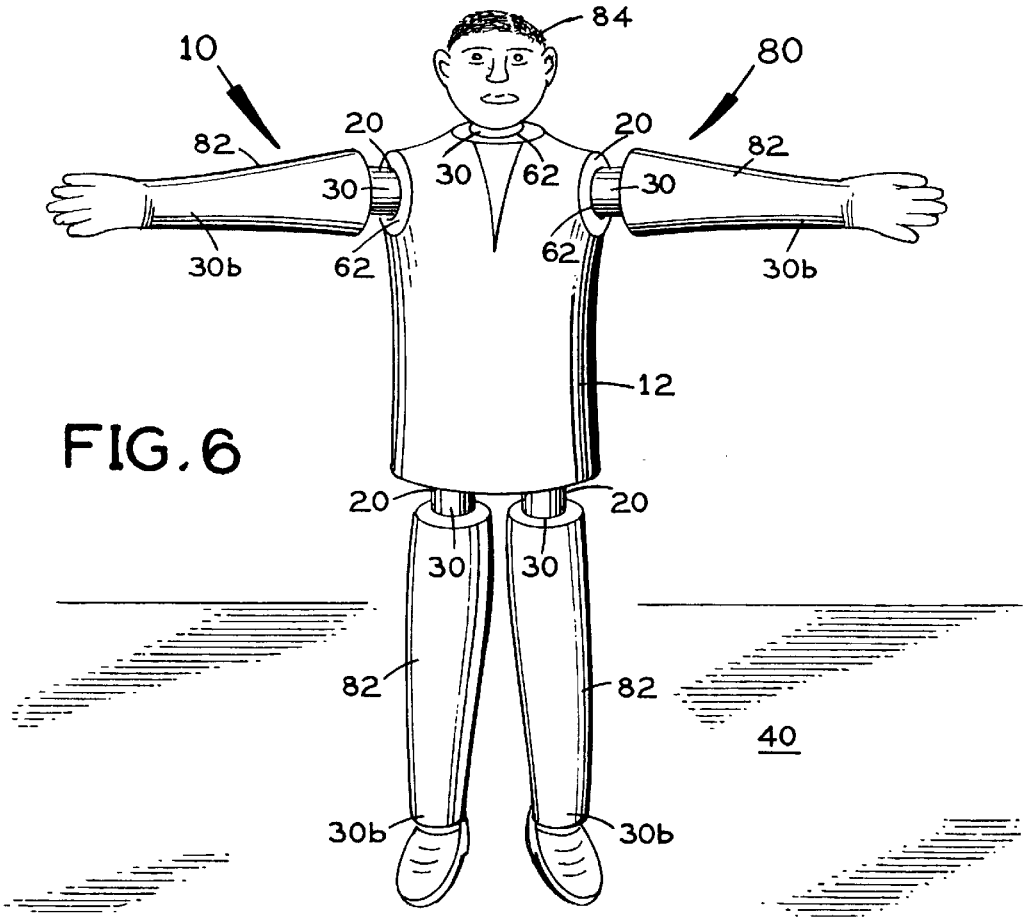
FIG. 6
FIG. 7
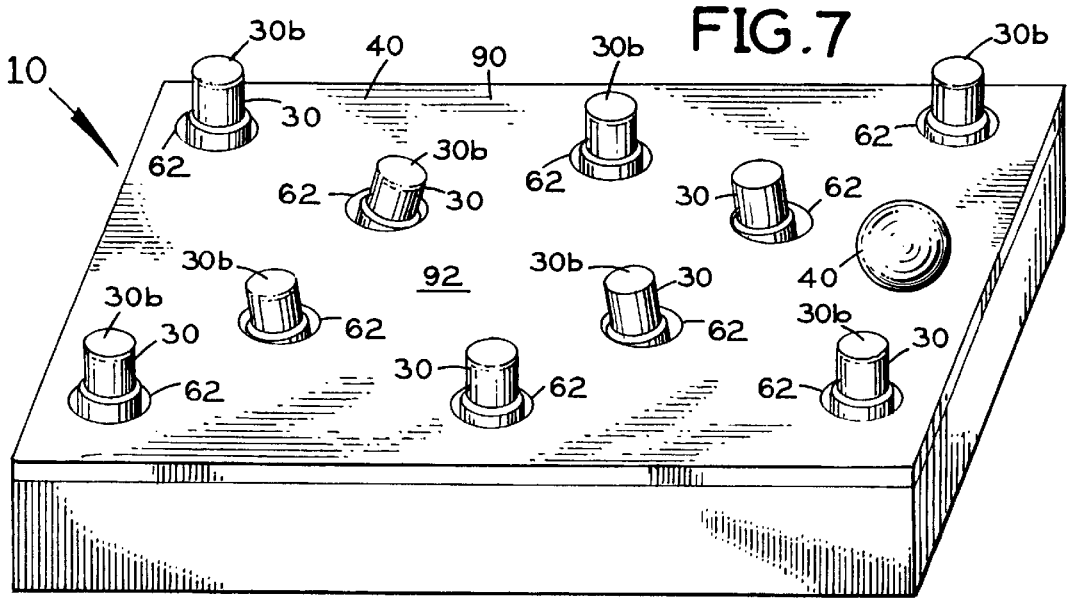

TOY WITH DIRECTIONALLY SELECTABLE SPRING-LOADED PROPULSION MECHANISMS

BACKGROUND OF THE INVENTION

1. Field of the Invention

The present invention relates generally to the field of toys animated by energy-storing mechanisms. More specifically the present invention relates to a toy including a toy shell portion configured for any of several specific play functions and including a spring-loaded, directionally selectable propulsion mechanism.

The propulsion mechanism includes a coil spring secured at a spring base end to the toy shell portion and at a spring free end to a projection member. The projection member has an outwardly extending contact end and an inwardly directed stop end and has a circumferential shoulder between the contact end and the stop end. The projection member protrudes between opposing and spaced apart shoulder engaging structures, so that pressing the projection member toward the shell against the biasing of the spring and then tilting the projection member laterally to a certain angle causes the shoulder to move underneath a shoulder engaging structure, and so that reducing pressure against the projection member and spring causes the shoulder to move against and into engaging contact with the shoulder engaging structure. As a result of this construction, an impact of the projection member with another object such as the floor, another toy or an element of the same toy, dislodges the shoulder from the shoulder engaging structure, freeing the projection member to accelerate outwardly under the power of the coil spring at substantially the selected angle of projection member tilt. The outwardly accelerating projection member rapidly bears against the triggering object and causes an entertaining movement of the toy.

The shell may take any of several forms, preferably including a play ball having a dozen of the above-described propulsion mechanisms evenly distributed over its surface, a person or animal figure having a propulsion mechanism mounted within each limb, a playing board having propulsion mechanisms scattered over its upper surface to be triggered by a ball rolled over the board, and a tubular network of branch tubes with tube connected ends joined to sides of other tubes and tube free ends fitted with propulsion mechanisms.

2. Description of the Prior Art

There have long been toys propelled by energy stored in internal springs and there have been toy balls constructed with means for random and unpredictable bouncing movements.

Hanshaw, U.S. Pat. No. 2,078,382, issued on Apr. 27, 1937, discloses a playing ball made of a resilient material such as rubber. Intersecting bands or spaced apart bumps made of the same resilient material protrude from the ball spherical surface and cause the ball to bounce at unpredictable angles upon impacting a play surface. The bands or bumps are spaced apart sufficiently that the even ball spherical surface occasionally and randomly strikes the play surface to rebound at a conventional angle approximating the angle of approach. A problem with Hanshaw is that the ball has no stored energy beyond that imparted to it from the force of a throw and from gravity, so that rebound velocity diminishes rapidly. Another problem is that the user has no control over rebound angles, limiting user involvement, variations in ball use and user interest.

Kulesza, et al., U.S. Pat. No. 4,466,214, issued on Aug. 21, 1984, teaches an impact-responsive toy vehicle. Kulesza, et al. includes a conventional toy vehicle with a vehicle body and vehicle wheels, with a spring-biased foot portion mounted underneath the vehicle floor and a foot portion triggering mechanism. The triggering mechanism includes a generally rectangular latching member which is mounted to slide parallel to the vehicle floor, the forward end of the latching member forming the vehicle front bumper and a rearward section fitting underneath the foot portion. When the toy vehicle is propelled forwardly on its wheels and strikes an obstacle, the impact depresses the front bumper, sliding the latching member rearwardly relative to the foot portion. The displacement of the latching member frees the foot portion to pivot with the force of the biasing spring and rapidly accelerate against the vehicle support surface, flipping the vehicle over to simulate a spectacular crash. Problems with Kulesza, et al. are that the user has no control over foot propulsion direction, and only one propulsion mechanism is provided so that a sequence of bouncing actions is not produced.

Simone, et al., U.S. Pat. No. 5,618,219, issued on Apr. 8, 1997, reveals a remote control toy vehicle with a powered jumper mechanism similar to that of Kulesza, et al. The only fundamental differences are that the foot member is cam-shaped rather than planar and is actuated by an electric motor rather than by spring release.

Weiss, U.S. Pat. No. 2,627,700, issued on Feb. 10, 1953, discloses a jumping puppet apparatus. The apparatus includes a miniature model human torso and a flexible skirt portion extending downwardly from the torso to puppet-supporting, interconnected puppet feet. A coil spring is mounted within a longitudinal tube extending into the base of the torso, and a radial flange extends inwardly from the perimeter of the downwardly directed tube opening. The spring bears against a piston, and a drive rod having a rod shoulder interconnects the piston and the puppet feet. To cock the jumping mechanism, the user presses the puppet feet toward the torso against the biasing of the coil spring until the rod shoulder passes the radial flange. Then the rod is slightly pivoted laterally and pressure against the spring is eased to cause the rod shoulder to bear against the radial flange. Dropping the upright puppet vertically causes the feet to strike a play surface, jar the rod and dislodge the shoulder from the radial flange. The coil spring then propels the drive rod and puppet feet downwardly against the play surface and causes the puppet to jump. A problem with Weiss is that the lateral positioning of the drive rod to cause the shoulder to engage the radial flange is very slight, and does not materially alter or control the puppet jumping direction. Another problem is that only one propulsion mechanism is provided, and thus no entertaining sequence of jumps is disclosed. Still another problem is that the spring does not overlap or enter the piston, so that the propulsion mechanism bore must be quite deep.

Maxim, et al., U.S. Pat. No. 5,297,981, issued on Mar. 29, 1994, teaches a self-propelled bouncing ball. This ball includes an outer spherical shell containing a motorized center of gravity shifting mechanism, rotating an internal weight around a diametric internal mounting shaft. While this ball produces random and generally unpredictable bouncing motion, the cost of its manufacture with the internal mechanism limits the product to a relatively high-end market. The rotating weight also provides for no user pre-selection of bounce directions.

Sonesson, U.S. Pat. No. 4,925,428, issued on May 15, 1990, reveals a ball with an unbalance mechanism. Sonesson includes a ball having a diametric internal bore lined with a guide tube containing a sliding piston weight. The weight includes a spring-powered mechanism which slides the piston weight from one end of the guide tube to the other end as the ball rolls, shifting the ball center of gravity and producing an irregular rolling pattern. A problem with Sonesson is that the user cannot select and pre-set rolling directions. Another problem is that the shifting of the center of gravity does not release stored ball propelling energy to the ball as it moves, limiting the play time for each roll. Still another problem is that no entertaining jumping action is produced.

Lacey, U.S. Pat. No. 3,106,397, issued on Oct. 8, 1963, discloses a ball toy having spring-loaded propulsion mechanisms projecting from discrete points over the ball exterior surface. The ball is essentially a solid spherical body and each propulsion mechanism includes a radial bore in the body containing a coil spring. Each bore has a circumferential internal latching groove. A hollow cylindrical piston with a laterally extending latching structure is slidably fitted into each bore against the biasing of the coil spring. The latching structure is connected to a triggering pin protruding outwardly through the piston, and engages the latching groove. When the ball is dropped and one of the propulsion mechanism pins strikes the ground, the impact dislodges the latching structure from the groove and thereby releases the piston to slide within the bore. The coil spring drives the piston rapidly outward to strike the ground and propel the ball away from the ground, so that upon landing again, another propulsion mechanism pin may be struck, producing a series of bounces or jumps. A problem with Lacey is that the user cannot select and pre-set the directions of ball propulsion.

It is thus an object of the present invention to provide a toy with several propulsion mechanisms, each of which stores energy independently for sequential propulsion of the toy or a part of the toy.

It is another object of the present invention to provide such a toy in which each propulsion mechanism propels the toy in a selected and approximately pre-set individual direction, does not require a deep bore or recess and is compact.

It is still another object of the present invention to provide such a toy which prolongs bouncing action by releasing energy which is stored prior to bouncing sequence initiation.

It is finally an object of the present invention to provide such a toy which is economical to manufacture, simple, sturdy and genuinely intriguing for children and adults alike.

SUMMARY OF THE INVENTION

The present invention accomplishes the above-stated objectives, as well as others, as may be determined by a fair reading and interpretation of the entire specification.

A toy is provided for entertaining a user, including a shell portion configured to execute a play function, and at least one propulsion mechanism including a spring-loaded, directionally selectable propulsion member connected to the shell portion.

The at least one propulsion mechanism preferably includes one of the projection members, a coil spring having a compressed mode and a relaxed mode and having a spring base end and a spring free end, the spring base end being connected to the shell portion and a the spring free end being connected to the projection member, a structure for retaining the spring in a compressed mode and angled to a selected direction, and a structure for releasing the spring from the compressed mode upon impact of the projection member with a triggering object to propel the shell portion and the triggering object apart from each other. The at least one projection member preferably includes an outwardly extending contact end and an inwardly directed stop end, where the structure for retaining the spring and the structure for releasing the spring include a circumferential shoulder between the contact end and the stop end, and where the projection member protrudes outwardly from the shell portion between opposing and spaced apart shoulder engaging structure portions, so that pressing the projection member toward the shell portion against the biasing of the spring and then tilting the projection member laterally to a certain angle in the selected direction causes the shoulder to move underneath one of the shoulder engaging structure portions, and so that subsequently reducing pressing force against the projection member causes the shoulder to move against and into engaging contact with the shoulder engaging structure portion, and so that impact of the projection member with the triggering object dislodges the shoulder from the shoulder engaging structure portion, thereby freeing the projection member to accelerate outwardly with the force of the coil spring against the triggering object.

It is preferred that the projection member is a projection cup member having a substantially circular cup end wall and a tubular cup side wall, and that the shoulder is a circumferential along the cup side wall, and that the spring base end is anchored within a recess in the shell portion, and the spring is longer in the relaxed mode than the projection cup member and extends into the cup member, the spring free end being connected to the cup end wall, and that the shoulder engagement structure includes a lip protruding radially inwardly around the outer end of the recess.

The recess preferably includes a recess cup member fitted into a recess receiving port in the shell portion and having a circular recess bottom wall and a tubular recess side wall and includes an outwardly bent shell engaging rim which engages the edge of the recess receiving port.

The triggering object is optionally a play surface and the shell portion optionally includes a play ball having several of the propulsion mechanisms distributed over its surface for depressing and tilting by the user in individually selected directions into engagement with the shoulder engaging structure, so that projecting the ball against the play surface causes at least one of the projection members to contact the play surface and release the at least one projection member from engagement with its shoulder engaging structure, and so that the at least one projection member springs outwardly and delivers a propulsion member force against the play surface in a direction corresponding to the direction in which the projection member was tilted and the force combines with and alters the existing directional momentum of the play ball.

Where the triggering object is a play surface, the shell portion still alternatively includes a figure having at least first and second limbs and a projection member extending to and connecting each of the first and second limbs to the figure, so that delivering the toy against a play surface and impacting the first limb releases the projection member within the first limb from its shoulder engagement structure, accelerating the toy away from the play surface, and so that delivering the toy against the play surface and impacting the second limb releases the projection member within the second limb from its shoulder engagement structure, again accelerating the toy away from the play surface.

The shell portion alternatively includes a playing board with a board upper surface and several of the propulsion mechanisms extending upwardly from and scattered over the board upper surface. The toy further includes a board ball for rolling over the board, striking and triggering the propulsion mechanisms in sequence, so that the board ball is propelled by the propulsion mechanisms in a sequence of directions corresponding to the projection member selected directions.

The shell portion still alternatively includes a tubular network of branch tubes, each branch tube having a tube connected end joined to a side of another branch tube and at least one branch tube having a tube free end fitted with a propulsion mechanism. The branch tubes are optionally of several different lengths.

BRIEF DESCRIPTION OF THE DRAWINGS

Various other objects, advantages, and features of the invention will become apparent to those skilled in the art from the following discussion taken in conjunction with the following drawings, in which:

FIG. 6 is a front view of the figure embodiment of the present invention in which propulsion mechanisms connect the limbs and head to the figure body, so that triggering these mechanisms drives the limb or head rapidly outward and causes the figure to bounce.

FIG. 7 is a perspective view of the playing board embodiment and board ball.

DETAILED DESCRIPTION OF THE PREFERRED EMBODIMENTS

Figure 1:
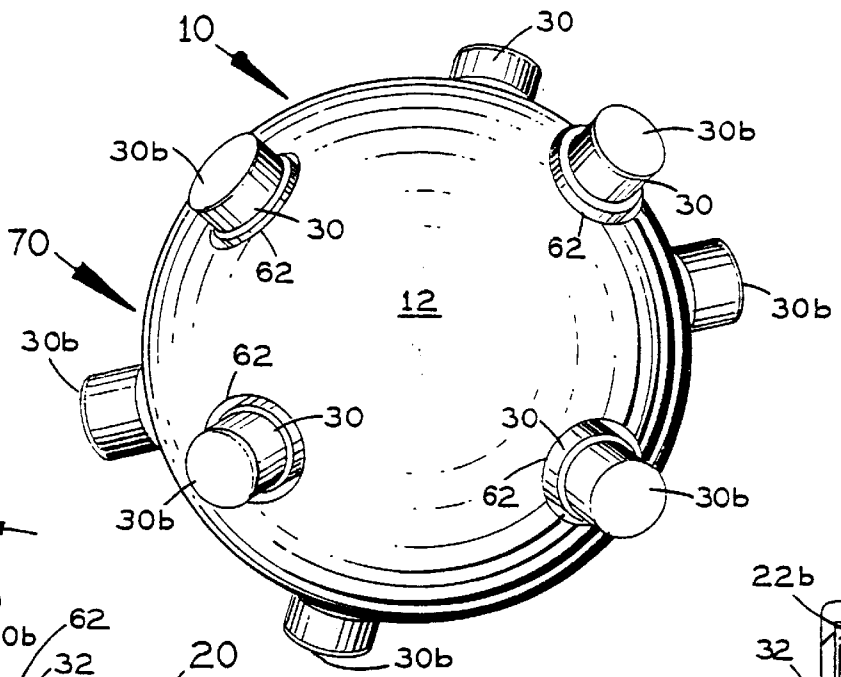
FIG. 1 is a perspective view of the play ball embodiment of the present invention with the projection members released and at full extension.
Figure 2:
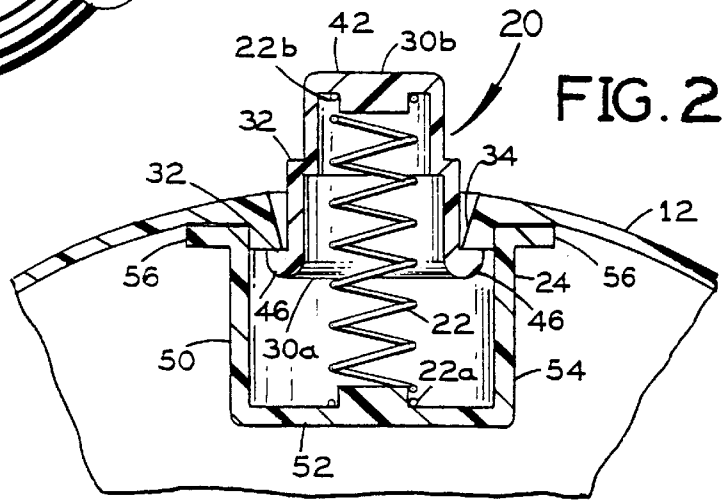
FIG. 2 is a cross-sectional side view of a propulsion mechanism with the projection member cup released and at full extension.
Figure 3:
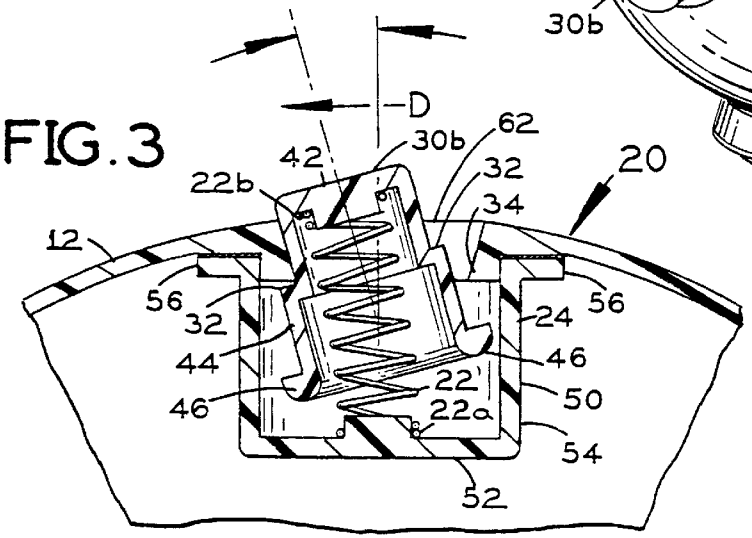
FIG. 3 is a view as in FIG. 2, but showing the projection member cup depressed and tilted with the shoulder engaged by the shoulder engaging structure.
Figure 4:
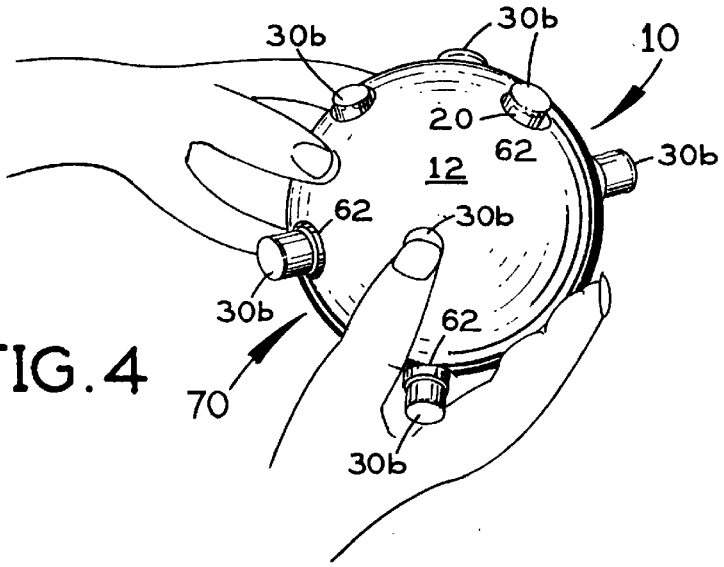
FIG. 4 is a perspective view of the propulsion mechanisms of the play ball of FIG. 1 being depressed and engaged by the shoulder engaging structure at selected angles by the user.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Referring to FIGS. 1–10, a toy 10 is disclosed including a toy shell portion 12 visually and structurally configured for execution of any one of several specific play functions, and including several spring-loaded, directionally selectable propulsion mechanisms 20 distributed over shell portion 12. Propulsion mechanisms 20 each include a coil spring 22 secured at a spring base end 22*a* to a toy shell retaining portion 24 and at a spring free end 22*b* to a projection member 30. Each projection member 30 has an inwardly directed stop end 30*a*, an outwardly extending contact end 30*b* and has a circumferential shoulder 32 between stop end 30*a* and the contact end 30*b*. See FIG. 2. Projection members 30 each protrude outwardly from shell retaining portion 24 between opposing and spaced apart shoulder engaging structures 34, such that pressing the projection member 30 toward the shell portion 12 against the biasing of the spring 22 and then significantly tilting the projection member 30 laterally, preferably at least ten degrees, causes shoulder 32 to move underneath a shoulder engaging structure 34, and such that reducing pressure against the projection member 30 causes the shoulder 32 to move against and into engaging contact with the shoulder engaging structure 34. See FIGS. 3 and 4.

As a result of this construction, impact of the projection member 30 with triggering object or play surface 40 such as the floor, another toy or an element of the same toy, dislodges the shoulder 32 from the shoulder engaging structure 34 and thereby frees the projection member 30 to accelerate outwardly with the stored force of the coil spring 22. The outwardly accelerating projection member 30 rapidly bears against the triggering object 40 and causes an entertaining and enhanced bounce of the toy 10. Sequential striking of depressed and engaged projection members 30 releases members 30 to create a sequence of enhanced bounces.

Each projection member 30 is preferably a cup having a circular contact end wall 42 and a tubular cup side wall 44, the shoulder 32 being a circumferential diameter changing step midway along the side wall 44. Spring 22 preferably has a spring base end 22*a* mounted within a shell retaining portion 24 recess in shell portion 12 with a first bent-over tab or clip. Spring 22, which is longer at rest than projection member 30, preferably extends into the projection member 30 cup and spring outward end 30*b* is secured to cup end wall 42 with a second bent-over tab or clip. The stop end 30*a* of the projection member 30 cup is a cup rim 46 which abuts the shell retaining portion 24 recess and thereby acts as a stop when the projection member 30 is depressed sufficiently to permit shoulder 32 engagement with an engaging structure 34 and acts as a stop against the shoulder engaging structure when the projection member 30 reaches full extension. The shoulder engaging structure 34 is preferably a recess lip or ridge protruding radially inward around the shell retaining portion 24 recess outer end. The recess itself is preferably a recess cup member 50 having a circular recess bottom wall 52 and a tubular recess side wall 54 and having an outwardly bent recess engaging rim 56 which engages the shell portion 12 around the perimeter of a projection member port 62. The edge of the projection member port 62 preferably has a barb-configured cross-section. See FIG. 2.

The shell portion 12 may take any of many forms, preferably including a play ball 70 having a dozen of the above-described propulsion mechanisms 20 evenly distributed over its surface. See FIG. 1. The twelve projection members 30 are sequentially depressed and tilted by the user in selected tilt directions D into latching engagement with the shoulder engaging structure 34. Dropping or tossing the ball 70 against a triggering object or play surface 40 such as a floor causes one or more projection members 20 to contact the surface 40 and become dislodged from engaging structure 34, so that it or they spring outwardly and drive ball 70 in a direction opposite the direction D in which the projection member 30 was tilted during cocking. A moment later ball 70 strikes surface 40 again and normally triggers other projection members 30 to release and accelerate ball 70 in a new direction.

Figure 5:
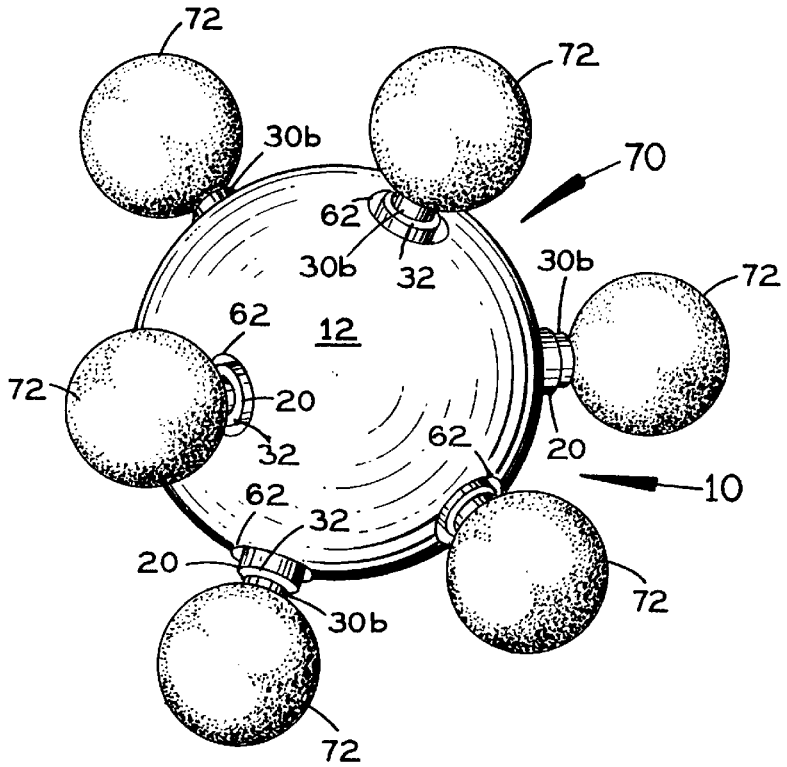
FIG. 5 is a perspective view of the play ball of FIG. 1, but with the optional foam rubber tips on the projection members.
Figure 8:
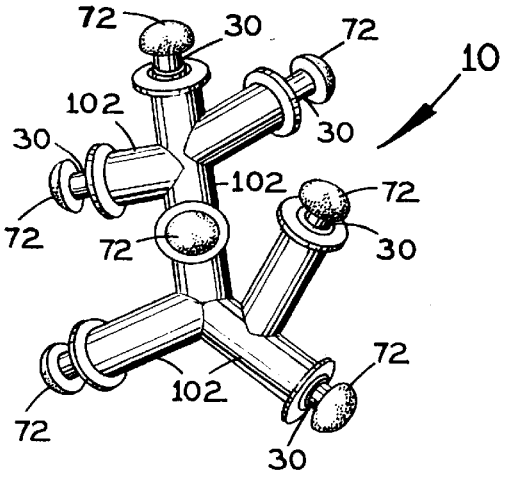
FIGS. 8 and 9 are perspective views of the tubular network embodiment of the invention.
Figure 9:
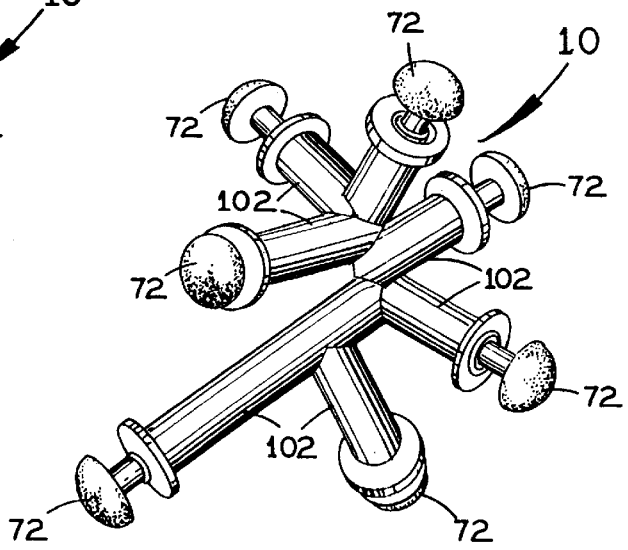
Figure 10:
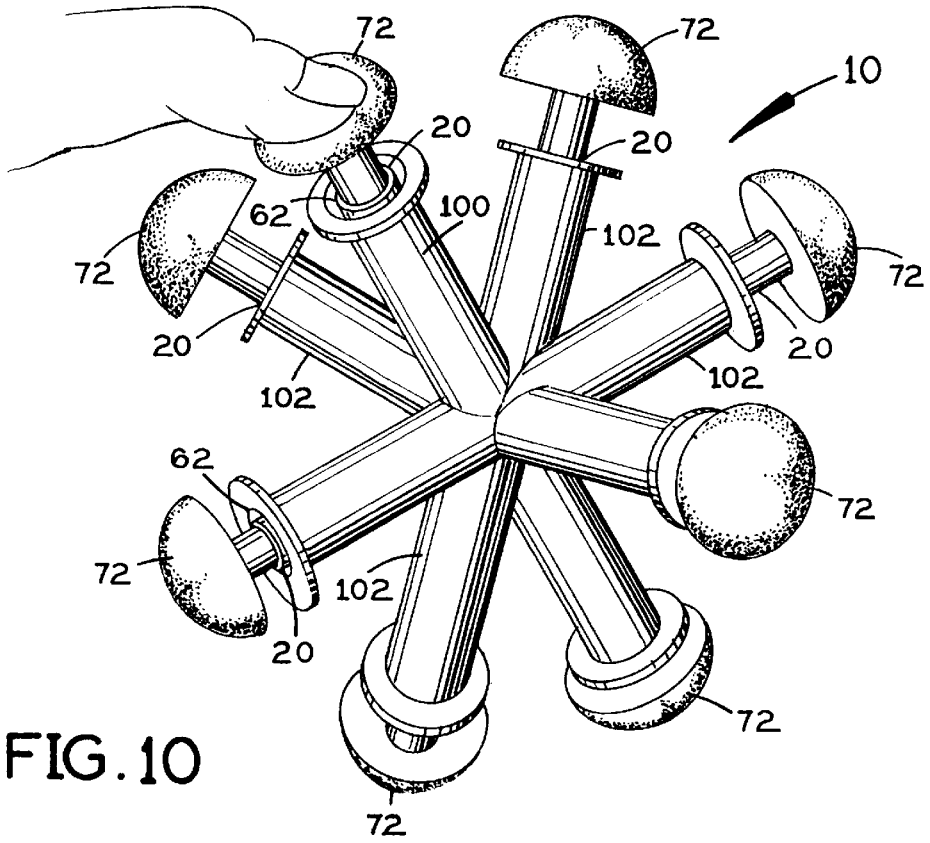
FIG. 10 is a close-up perspective view of the embodiment shown in FIGS. 8 and 9, with one of the propulsion mechanisms being depressed and engaged by the user.

For spherical balls bouncing on planar surfaces, the angle of ball arrival approximately equals the angle of departure, so that rebound direction is consistent and fully predictable. The cocked projection members 30 of the present ball 70, however, drive the ball 70 in a direction which may not correspond with the typical rebound angle because the spring 22 force of the outwardly moving projection member 30 combines with and alters the existing directional momentum of ball 70. As a result the ball 70 bounces with additional repelling force and in a sequence with a variety of pre-selected directional biases. One ball 70 may be tossed into a group of other balls 70 so that they trigger each other and create a more complex, fast moving display. The contact ends of projection members 30 are optionally covered by or fitted into foam cushions 72 as shown in FIG. 5 to assist the user in depressing and engaging the projection members 30.

The shell portion 12 may alternatively take the form of person or animal FIG. 80 and a propulsion mechanism 20 is mounted within each figure limb 82, whether an arm, a leg or the head. See FIG. 6. Dropping the toy 10 against a surface 40 triggers the projection member 30 within the limb or limbs 82 impacting surface 40, causing the toy 10 to accelerate away from surface 40 and thus hop. As gravity brings the toy 10 into contact with surface 40 again, another limb 82 or the head 84 may make contact with surface 40, causing the toy 10 to hop again, so that an entertaining sequence of FIG. 80 movement is produced.

The shell portion 12 may still alternatively take the form of a playing board 90 with propulsion mechanisms 20 scattered over its upper surface 92. See FIG. 7. The projection members 30 are directed upwardly from board 90. A weighted ball 40 such as the steel balls found in pin ball machines is propelled or simply rolled over board 90, striking and triggering one propulsion mechanism 20, which propels the ball 40 in a selected direction to strike another propulsion mechanism 20 which propels ball 40 in another direction until it strikes still another propulsion mechanism 20. This pattern of movement sustains itself with the sequential and repeated input of energy stored in the propulsion mechanisms 20 struck by ball 40 until either ball 40 strays off the board 90 or strikes and triggers all of the propulsion mechanisms 20. Any of various board or pinball type games can be built around this embodiment.

Still another contemplated form for shell portion 12 to take is a tubular network 100 of branch tubes 102 of varying lengths interconnected in a generally random fashion. See FIGS. 8–10. Each branch tube 102 has a connected end joined to the side of another tube 102 and a free end fitted with a propulsion mechanism 20. When used this version behaves much like the play ball 70 embodiment, bouncing and triggering a sequence of mechanisms 20.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A toy for entertaining a user, comprising:

a shell portion configured to execute a jumping play function;

and at least two propulsion mechanisms, each propulsion mechanism including a spring-loaded, directionally selectable propulsion member forming part of said shell portion;

wherein said at least two propulsion mechanisms comprise;

one projection member;

a coil spring having a compressed mode and a relaxed mode and having a spring base end and a spring free end, said spring base end being connected to said shell portion and a said spring free end being connected to said projection member;

means for retaining said spring in a compressed mode and angled to a selected direction;

and means for releasing said spring from said compressed mode upon impact of said projection member with a triggering object to propel said toy and said triggering object apart from each other;

wherein said at least two projection members each comprise an outwardly extending contact end and an inwardly directed stop end;

wherein said means for retaining said spring and said means for releasing said spring comprise a circumferential shoulder between said contact end and said stop end;

and wherein said projection member protrudes outwardly from within an inwardly directed shell portion port, such that pressing said projection member into said inwardly directed shell portion port against the biasing of said spring and then tilting said projection member laterally in said selected direction causes said shoulder to move underneath part of said inwardly directed shell portion port, and such that subsequently reducing pressing force against said projection member causes said shoulder to move against and into engaging contact with said inwardly directed shell portion port, and such that impact of said projection member with said triggering object dislodges said shoulder from said inwardly directed shell portion port, thereby freeing said projection member to accelerate outwardly with the force of said coil spring against said triggering object;

such that the outward acceleration of one said projection member provides sufficient energy to propel said toy off a support surface, and such that gravity induced return of said toy to said support surface may cause triggering of another one of said at least two propulsion mechanisms.

2. A toy for entertaining a user, comprising: a shell portion configured to execute a play function, and at least one propulsion mechanism including a spring-loaded, directionally selectable propulsion member connected to said shell portion;

wherein said at least one propulsion mechanism comprises:

one said projection member;

a coil spring having a compressed mode and a relaxed mode and having a spring base end and a spring free end, said spring base end being connected to said shell portion and a said spring free end being connected to said projection member;

means for retaining said spring in a compressed mode and angled to a selected direction;

and means for releasing said spring from said compressed mode upon impact of said projection member with a triggering object to propel said shell portion and said triggering object apart from each other;

wherein said at least one projection member comprises an outwardly extending contact end and an inwardly directed stop end;

wherein said means for retaining said spring and said means for releasing said spring comprise a circumferential shoulder between said contact end and said stop end;

and wherein said projection member protrudes outwardly from said shell portion between opposing and spaced apart said shoulder engaging structure portions, such that pressing said projection member toward said shell portion against the biasing of said spring and then tilting said projection member laterally to a certain angle in said selected direction causes said shoulder to move underneath one said shoulder engaging structure portion, and such that subsequently reducing pressing force against said projection member causes said shoulder to move against and into engaging contact with said shoulder engaging structure portion, and such that impact of said projection member with said triggering object dislodges said shoulder from said shoulder engaging structure portion, thereby freeing said projection member to accelerate outwardly with the force of said coil spring against said triggering object;

wherein said projection member is a projection cup member having a substantially circular cup end wall and a tubular cup side wall, and wherein said shoulder is a circumferential jog along said cup side wall, and wherein said spring base end is anchored within a recess in said shell portion;

wherein said spring is longer in said relaxed mode than said projection cup member and extends into said cup member, wherein said spring free end is connected to said cup end wall;

and wherein said shoulder engagement structure comprises a lip protruding radially inwardly around the outer end of said recess.

3. A toy according to claim 2, wherein said recess comprises a recess cup member fitted into a recess receiving port in said shell portion and having a circular recess bottom wall and a tubular recess side wall and comprises an outwardly bent shell engaging rim which engages the edge of said recess receiving port.

4. A toy according to claim 2, wherein said triggering object is a play surface and wherein said shell portion comprises:

a play ball having a plurality of said propulsion mechanisms distributed over its surface for depressing and tilting by the user in individually selected directions into engagement with said shoulder engaging structure, such that projecting said ball against a play surface causes at least one said projection member to contact said play surface and release said at least one projection member from engagement with its shoulder engaging structure, and such that said at least one projection member springs outwardly and delivers a propulsion member force against said play surface in a direction corresponding to the direction in which said projection member was tilted and said force combines with and alters the existing directional momentum of said play ball.

5. A toy according to claim 2, wherein said triggering object is a play surface and wherein said shell portion comprises a figure having at least first and second limbs and a projection member extending to and connecting each of said first and second limbs to said figure, such that delivering said toy against a play surface and impacting said first limb releases the projection member within said first limb from its shoulder engagement structure, accelerating said toy away from said play surface, and such that delivering said toy against said play surface and impacting said second limb releases the projection member within said second limb from its shoulder engagement structure, again accelerating said toy away from said play surface.

6. A toy according to claim 2, wherein said shell portion comprises a playing board with a board upper surface and a plurality of said propulsion mechanisms extending upwardly from and scattered over said board upper surface, said toy additionally comprising a board ball for rolling over said board, striking and triggering said propulsion mechanisms in sequence, such that said board ball is propelled by said propulsion mechanisms in a sequence of directions corresponding to said projection member selected directions.

7. A toy according to claim 2, wherein said shell portion comprises a tubular network of branch tubes, each said branch tube having a tube connected end joined to a side of another said branch tube and at least one said branch tube having a tube free end fitted with a propulsion mechanism.

8. A toy according to claim 7, wherein said branch tubes are of several different lengths.

* * * * *